United States Patent [19]

Hartley et al.

[11] 4,243,434

[45] Jan. 6, 1981

[54] COMPOSITION FOR COATING METAL-WORKING TOOLS

[75] Inventors: David Hartley, Normanton; Michael D. Barrett, Sutton Coldfield; Paul Wainwright, Horsforth, all of England

[73] Assignee: Rocol Limited, England

[21] Appl. No.: 910,340

[22] Filed: May 30, 1978

[51] Int. Cl.[3] ..... C23F 7/10

[52] U.S. Cl. ..... 148/6.15 R; 148/6.16; 252/30; 252/49.8; 252/49.9; 252/31

[58] Field of Search ..... 148/6.15 R, 6.15 Z, 148/6.17, 6.16; 252/22, 23, 29, 30, 49.8, 49.9

[56] References Cited

U.S. PATENT DOCUMENTS

| | | | |
|---|---|---|---|
| 2,008,939 | 7/1935 | Tufts | 252/49.3 |
| 2,534,406 | 12/1950 | Bramberry | 148/6.15 R |
| 2,939,809 | 6/1960 | Jensen et al. | 148/6.15 R |
| 3,361,666 | 1/1968 | Webb | 252/30 |
| 3,637,498 | 1/1972 | Sawyer | 252/30 |
| 3,904,443 | 9/1975 | Sullivan et al. | 148/6.15 R |

FOREIGN PATENT DOCUMENTS

| | | | |
|---|---|---|---|
| 327774 | 9/1972 | U.S.S.R. | 252/30 |

*Primary Examiner*—Ralph S. Kendall

*Attorney, Agent, or Firm*—Larson, Taylor and Hinds

[57] ABSTRACT

A composition for coating a metal-working tool to increase tool life, comprising graphite, molybdenum disulphide or other solid lubricant in an aqueous binder solution comprising a phosphate of aluminium, magnesium, zinc, calcium or other metal and preferably a chromate or dichromate as well.

2 Claims, No Drawings

COMPOSITION FOR COATING METAL-WORKING TOOLS

The invention relates to solid lubricants for metal-working tools.

Tools used in machining, drawing and general metal forming, cutting and other working operations are customarily lubricated with liquid lubricants in the form of straight oils or emulsions. Tool life however is not always satisfactory and we have sought to improve it.

Our approach is to coat the tool with an adherent, solid lubricant film of the kind described below that remains on the tool when it is used with conventional lubricants and gives a protective and wear-reducing effect.

Thus, according to one aspect of the invention, a metal working tool, particularly a metallic tool, is provided with an adherent solid film comprising a molybdenum disulphide, graphite or other solid lubricant and a phosphate salt binder preferably containing a chromate also. Preferably the coating is 0.0001 to 0.001 inch thick.

According to another aspect of the invention there is provided a method of working metal in which such a tool is used.

According to a further aspect of the invention there is provided a method of preparing a metal working tool for use in which the tool is coated with a composition containing the binder and solid lubricant above.

The invention also extends to the dispersions, normally aqueous, for use in the coating process, as well as concentrates for making them up.

Preferably the binder is derived from a solution of an aluminium, magnesium, zinc or calcium phosphate, particularly a chromium trioxide (chromic anhydride)-containing mono aluminium phosphate, $Al(H_2PO_4)_3$, solution. The presence of excess phosphoric acid is preferred as it gives a smoother coating and slight etching to help adhesion. The solid lubricant is present in dispersed form, and desirably a surface-active agent is present to aid maintenance of the dispersion.

A suitable proportion of the above mono aluminium phosphate would be for example 100 to 500 g per liter of solution i.e. 10 to 50% weight by volume.

The total composition may be as for example follows (by weight):

| | | |
|---|---|---|
| Ortho phosphoric acid (calculated as the 88 to 93% acid) | 3 to 25 | parts |
| Aluminium phosphate (calculated as aluminium hydroxide) or molar equivalent amount of other metal phosphate | 1 to 5 | parts |
| Chromate calculated as chromium trioxide | 0 to 5 | parts |
| Molybdenum disulphide, graphite or other solid lubricant | 5 to 60 | parts |

The composition as used preferably contains 50 to 80 parts of water total but may be sold with or without all or part of the water. A surface active agent, for example 'Texafor 85FP' is preferably present, for example 0.1 to 2 parts on the same basis.

Alternatives to the chromium trioxide, containing equivalent amounts of chromium as chromium trioxide, are:

| | |
|---|---|
| Potassium Chromate | up to 10 parts |
| Potassium Dichromate | up to 8 parts |
| Sodium Chromate | up to 8 parts |
| Sodium Dichromate | up to 12 parts |

The purpose of the chromium content is to inhibit the acid phosphoric binder from undesired chemical action on the tool. The Texafor 85FP is an alkyl phenol condensate surface active agent of H1B value 12.4.

In preparing the tools at least the working edges or faces are coated, together, in the case of cutting tools, with faces over which swarf will pass. Usually the whole tool will be coated.

The ease with which swarf passes away from the cutting edge of a cutting tool is an important benefit of the invention gained by such coating, prolonging the life of the cutting edge itself. A similar effect is obtained in a punch for example, where the working parts of the tool effectively include not only the face which punches out metal from the hole but the sides also, which are in contact with the sides of the hole as the punch carries out its stroke.

Application may be by spray, dip, brush or other method, the dispersion desirably being kept thoroughly agitated. Application is followed by heat curing to improve adhesion, for example an hour or more at 200° C. to 250° or three hours or more at 180° C. A typical final coating thickness is for example 0.0001 or 0.0002 inch, but thicker coatings for example up to 0.001 inch can be obtained if required by multiple applications with intermediate drying. Air drying, for example 10 minutes at 20° C. to 25° C. or 2 to 3 minutes at 60° C. to 80° C., is suitable. The dispersion itself is preferably kept at 15° C. to 30° C. during application and tools to be coated may be warmed if desired, for example to 60° C. to 80° C., to speed drying. The final coating is heat cured as before. Neither drying nor curing temperatures are critical.

The tool should be clean before coating but simple solvent washing or vapour degreasing, for example in 'Genklene' (Trade Mark) (1,1,1-trichlorethane), is sufficient. Carbon steel and high speed steel tools, including chromium plated tools, have for example been successfully coated. So also have ceramic tools, for example sintered aluminium oxide.

Specific examples of final compositions showing various sources of chromate (parts by weight) are:

| | A | B | C | D | E |
|---|---|---|---|---|---|
| Mono-Aluminium Phosphate Solution (below) | 25.0 | 25.0 | 25.0 | 25.0 | 25.0 |
| Wetting Agent ('Texafor'85FP) | 0.4 | 0.4 | 0.4 | 0.4 | 0.4 |
| Molybdenum Disulphide | 20.0 | 20.0 | 20.0 | 20.0 | 20.0 |
| Chromium Trioxide | 1.3 | — | — | — | — |
| Potassium Chromate | — | 2.6 | — | — | — |
| Sodium Dichromate | — | — | 1.9 | — | — |
| Potassium Dichromate | — | — | — | 1.9 | — |
| Sodium Chromate | — | — | — | — | 4.5 |
| Water | 53.3 | 52.0 | 52.7 | 52.7 | 50.1 |

Specific examples of final compositions showing variation in the solid lubricants are (parts by weight):

| | F | G | H |
|---|---|---|---|
| Mono Aluminium Phosphate Solution (below) | 12.5 | 25.0 | 12.5 |

-continued

| | F | G | H |
|---|---|---|---|
| Wetting Agent ('Texafor 85FP) | 0.4 | 1.0 | 1.0 |
| Graphite | -- | 9.5 | 9.5 |
| Molybdenum Disulphide | 20.0 | — | — |
| Chromium Trioxide | 0.65 | 1.3 | 0.65 |
| Water | 66.45 | 63.2 | 76.35 |

The mono aluminium phosphate solution used (magnesium phosphate solution is made up similarly) was:

| | |
|---|---|
| Distilled Water | 41.9 |
| Orthophosphoric Acid (88 to 93%) | 41.9 |
| Aluminium Hydroxide | 16.2 |

Of the coatings showing variation in the solid lubricant, and referring to A also, coatings A and F are preferred at normal temperatures and coatings G and H at high temperatures, for fluid lubricated and non fluid lubricated applications respectively in each case.

All the above compositions gave satisfactory results. Tests were further done in a rig loading specimens together under heavy stress and turning, using various amounts of molybdenum disulphide (the composition otherwise being that given at A above).

The results are given below:

| | Twist Compression Tests | |
|---|---|---|
| % $MoS_2$ | Revs. to failure | μ prior to failure |
| 0 (Comparison) | 3 | 0.2 |
| 10 | 50 | 0.12 |
| 20 | 550 | 0.05 |
| 60 | 900 | 0.05 |
| Contact Stress | 20 tsi (3 K bar) | |
| Rotational Speed | 26 rpm (4ft/min sliding) | |
| Substrate | AISI D3 (60 R: 1 ins CLA) | |
| Specimen | EN3A (mild steel) | |
| Area of Contact | 1.3 sq.ins. | |

Other tests were done by the 'Falex' method using various amounts of chromate (as $CrO_3$) the rest of the composition being that given at A above, giving results that showed the chromium content, added as noted herein to avoid any difficulty with action of the acid on tool metal, did not prevent the required load wear resistance from being shown.

The following examples of user tests illustrate the invention further. To carry them out the following aluminium phosphate solution (parts by weight) was made up:

| | |
|---|---|
| Ortho Phosphoric Acid (88 to 93%) | 55.80 |
| Aluminium Hydroxide | 12.31 |
| Distilled Water | 31.89 |
| | 100.00 |

and the solution was used to make up the following specific composition, (composition I) again expressed in parts by weight.

| | |
|---|---|
| Mono Aluminium Phosphate solution | 24.7 |
| Chromium Trioxide | 1.3 |
| Molybdenum Disulphide powder | 20.0 |
| 'Texafor' (Trade Mark) 85FP dispersing agent | 0.4 |
| Distilled Water | 53.6 |
| | 100.00 |

The composition was then used as follows:

EXAMPLE 1

Aluminium L93 and L94 forgings are milled with a double-flute router or slotter 2 inches diameter and 3 inches long, made of high speed steel, at a cutting speed of 1800 ft/min (3500 r.p.m.) taking a cut 2 inches wide and ½ inch deep. The forgings require approximately 24 hours machining time on an N.C. milling machine such as a Marwin Maximill (Trade Mark) Vertical 2 Spindle Head. With flood lubrication using a mineral oil emulsion such as Castrol Almasol A (Trade Mark) at 20:1 dilution, four components are normally milled before regrinding of the tool.

After coating the tool with the specific composition given earlier and with one spray coat dried one hour each at room temperature, 80° C. and 250° C., 15 or 16 such components can regularly be milled before regrinding is required.

EXAMPLE 2

Using the same coating composition similar results to Example 1 have been obtained:

(a) With a 6 inch×0.3165 inch side and face milling cutter machining EN 110 steel with soluble oil lubricant. An improvement of two to three times in tool life is given after two brush applications of the coating dried for 10 minutes at room temperature then 1 hour at 250° C.

(b) With end milling cutters machining titanium fan blades in a gang miller with oil emulsion lubrication, showing an improvement in tool life from average 20 to average 38 components after two dip applications of the coating dried 16 hours at room temperature and 1 hour at 250° C.

(c) With a 4 inch×5 inch hob, machining tractor timing gears in 60–70 T steel at 110 r.p.m. and 0.080 inch/rev. feed under soluble oil lubrication. Tool life was improved from an average 9 regrinds to an average 12 regrinds using two brushed applications of the coating with drying 16 hours at room temperature and 1 hour at 250° C.

(d) With a 28 mm high speed steel drill working at 220 r.p.m. and 0.006 inch/rev. feed, soluble oil lubrication, on forge steel 605/M 36 T components. Coating as in (c) raised average drill life from 1600 to 3200 components.

(e) With a ⅜ inch UNF tap working in 86/20 colourised hard steel 180/230 Brinell - 35/40 ton with Stewarts AP cutting fluid, and also with a Goliath U.K. KZS M20×1.573 tap working in cast iron with paraffin lubrication. Increases in tool life of 300% were gained, in the first case using a single dip coat, touched up by brush and dried 16 hours at room temperature and 1 hour at 250° C., and in the second case using three dip coats with nylon brush burnishing between coats.

EXAMPLE 3

Panteg 430 (Trade Mark) stainless iron gas burner plates $6.4\times10^{-3}$ inch thick (16 swg) are punched with 72 holes 17.1 mm diameter, drawn by the punching to 6.3 mm deep. High speed steel punches are used, made by grinding 0.001 inch undersize in diameter, hard chromium plating to 0.002 inch oversize and finish-grinding and polishing to size. Deep drawing lubricant diluted with engine oil is the lubricant.

The internal surfaces of the punched holes must for satisfactory performance be highly polished, without scratches or imperfections, and to achieve this finish, repolishing of the punch after every 4 to 6 holes has been necessary. The punch has generally finished approximately 0.001 inch undersize after making a plate and has been thrown away.

After coating according to the invention with one dipped coat, dried one hour at room temperature and 1 hour at 250° C., the punches produce a plate without repolishing and without measurable wear, and can continue to be used. A tool life of over twenty complete plates has been achieved.

Similar results were obtained with an 0.109 inch diameter high speed steel piercing punch for fully annealed bright mild steel jewellery components. The uncoated punches on test had an average life of 1500 holes and the coated ones 133,000 holes, without use of lubricant.

EXAMPLE 4

The coating composition used in the above examples was modified by use of flake graphite weight for weight, instead of disulphide, and three dip coatings, each dried 10 minutes at 60° C. and 1 hour at 250° C. and burnished with paper cloth between coats, were applied to a Wickman Wimet (Trade Mark) carbide tipped end milling cutter. Used to machine contact breaker parts of Ferrosil 170 (Trade Mark) soft iron in fully annealed blue oxide finish, with an unlubricated cut of 0.005 to 0.007 inch at 1125 r.p.m., the cutters showed an increase in average life from 1,750 to 8,500 components.

We claim:

1. An aqueous composition for coating a metal-working tool, comprising by weight
   (a) molybdenum disulphide or graphite solid lubricant in an amount of 5 to 60 parts,
   (b) an aluminum phosphate binder, in an amount of 1 to 5 parts calculated as aluminum hydroxide,
   (c) ortho-phosphoric acid, in an amount of 3 to 25 parts calculated as the 88 to 93% acid,
   (d) optionally a chromate or dichromate, in an amount of up to 5 parts calculated as chromium trioxide.

2. A composition according to claim 1, wherein the phosphate is mono-aluminum phosphate $Al(H_2PO_4)_3$.

* * * * *